United States Patent [19]

Reiher et al.

[11] 4,111,313

[45] Sep. 5, 1978

[54] DIVING BELL HANDLING SYSTEM AND METHOD

[75] Inventors: Max A. W. Reiher, Mandeville; Richard C. Faust, New Orleans, both of La.

[73] Assignee: J. Ray McDermott & Co., New Orleans, La.

[21] Appl. No.: 794,583

[22] Filed: May 6, 1977

[51] Int. Cl.[2] ..... B63B 35/40

[52] U.S. Cl. ..... 214/15 R; 405/185; 114/259; 212/3 R; 214/152

[58] Field of Search ..... 214/12, 13, 14, 15 R, 214/15 C, 15 D, 152; 212/3 R; 61/69 R, 69 A; 114/258, 259; 9/31, 35, 36

[56] References Cited

U.S. PATENT DOCUMENTS

| | | | |
|---|---|---|---|
| 1,136,938 | 4/1915 | Chupica | 9/35 X |
| 2,734,705 | 2/1956 | Robertson | 214/13 X |
| 2,887,235 | 5/1959 | Ladner | 214/14 X |
| 3,401,804 | 9/1968 | Link | 214/15 R X |
| 3,494,443 | 2/1970 | Huffhines | 214/12 X |
| 3,912,319 | 10/1975 | Hamilton | 214/15 R X |
| 3,955,522 | 5/1976 | Gaudiano et al. | 114/259 |

*Primary Examiner*—Frank E. Werner
*Attorney, Agent, or Firm*—Arnold, White & Durkee

[57] ABSTRACT

A handling system for lowering and lifting a diving bell between the ocean surface and the deck of a vessel or a marine platform includes a horizontally extendible and retractable frame which mounts sheaves used for directing the hoist cable and umbilical cable into communication with the bell. The frame comprises a pair of elongate beams driven by means of a pair of hydraulic motors having pinions which engage racks built integral with the beams. The frame includes a member having a downwardly opening frusto-conical inner surface which is adapted to mate with a similar frusto-conical superstructure on the diving bell. A plurality of locking fingers are operatively arranged on the upper frusto-conical member for automatically locking the superstructure to the frame in a stabilized position over the water.

16 Claims, 8 Drawing Figures

DIVING BELL HANDLING SYSTEM AND METHOD

BACKGROUND OF THE INVENTION

1. Field of the Invention.

The invention relates to apparatus and methods for handling diving vehicles, and more particularly, to apparatus and methods for lowering and lifting diving bells between the ocean surface and the deck of a vessel.

2. Description of the Prior Art.

Diving bells have been used for years in oceanographic research and related commercial applications. Recently, diving bells have been used in large numbers in the offshore petroleum industry, for example, in the installation and inspection of offshore pipelines.

In the handling of suspended or tethered diving bells it is well known that when a bell is lifted from the water by a hoist cable, waves striking the bell and motions of the marine structure may cause a serious pendulum effect resulting in violent motions of the diving bell. A first step in reducing the pendulum effect is to shorten the length of vertical travel as much as possible. However, the suspension of the diving bell requires a certain length of cable which necessarily results in the danger of a pendulum effect. A handling system dealing with the above-described pendulum problem is described in U.S. Pat. No. 3,518,837 which discloses a stabilizing bar that rides in contact with the top of the diving vessel as it is being lifted upwardly toward a support frame.

It has been found that a primary cause of the dangerous pendulum effect is that the diving bell is ordinarily raised quite slowly, especially during the least few feet of travel. Furthermore, after the bell has been fully raised by the hoist cable, according to prior art practices it has not been stabilized before moving it to a position over the deck of the vessel or marine platform.

One aspect of the present invention is the provision of a handling system whereby the vehicle may be raised rapidly from the water surface to a stabilized frame where it is secured over the water.

Another aspect of the invention is the provision of mating surfaces on the diving bell and the support frame such that the mating surfaces will automatically self-align and lock to stabilize the bell.

SUMMARY OF THE INVENTION

The apparatus and method of the present invention is adapted for lifting and lowering a diving bell or other submarine vehicle between the ocean surface and the deck of a barge. The apparatus includes a trussed frame which may be driven outwardly beyond the barge deck to a pick-up position and retracted to an above-deck release position by a rack-and-pinion drive system operating on a pair of elongate, movable beams. The frame mounts a sheave for the umbilical cable and a sheave for the winch cable. Secured to the lower portion of the frame is a downwardly opening frustrum having an inner configuration adapted for mating with a like frustrum secured to the upper portion of the diving bell. In lifting operations, the frame is driven to its pick-up position and the winch is operated to raise the bell at a constant speed. As the bell approaches the frame, the frustrums engage and, due to their mating configurations, they self-align to a locked, stabilized position. In a preferred embodiment, the upper frustrum includes a plurality of locking fingers which are biased inwardly through openings in the frustrum so that they engage with the bell-affixed frustrum. The fingers are preferably self-activating so that the lock is made automatically. After locking is complete, the frame may be retracted to a position where it is over the deck, and the locking fingers are then released so that the bell may be lowered to the deck. The bell may then be mated to the decompression chamber according to conventional procedures. The procedure for transferring the bell from the deck to the ocean surface is essentially a reverse of the lifting operation.

DESCRIPTION OF THE PREFERRED EMBODIMENT

Figure 1:
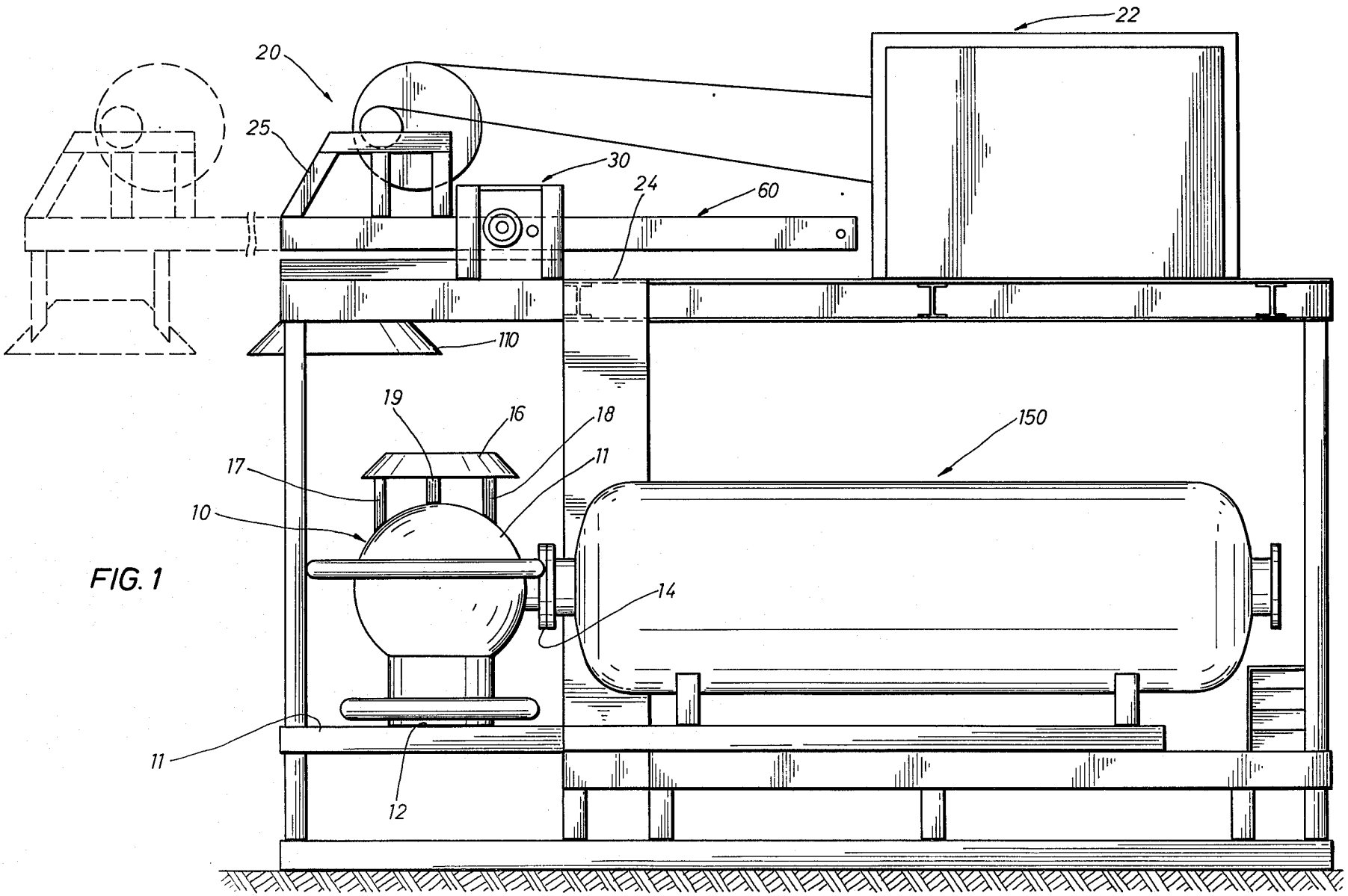
FIG. 1 is a partially schematic side view of a portion of a barge incorporating the diving bell handling system of the invention and showing the bell after it has been lowered to the deck and mated with a decompression chamber. The frame is shown in phantom in its extended position over the water.
Figure 2:
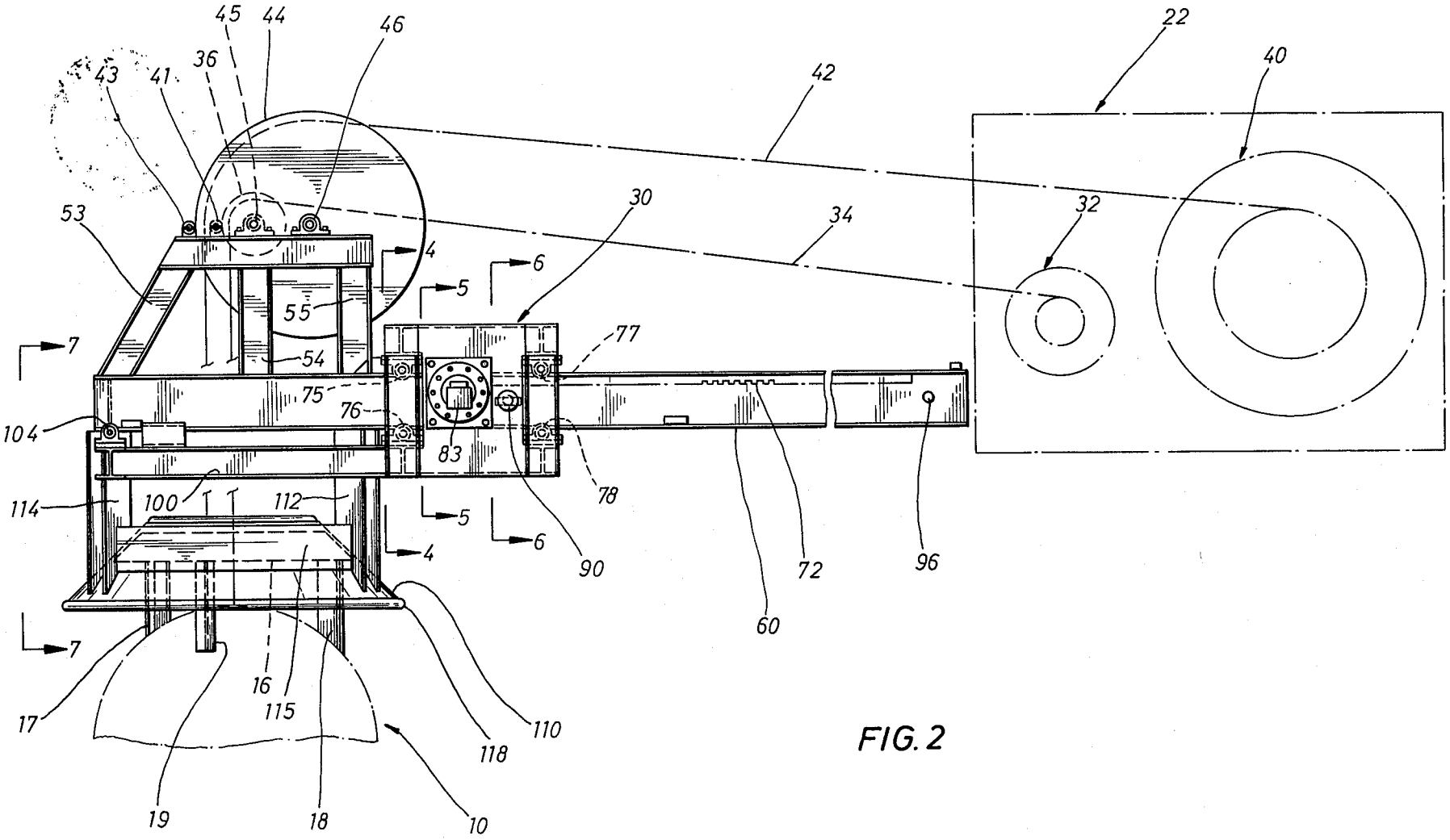
FIG. 2 is a side view of the winches, handling frame, and a portion of a diving bell showing the frustrums in a locked position.
Figure 3:
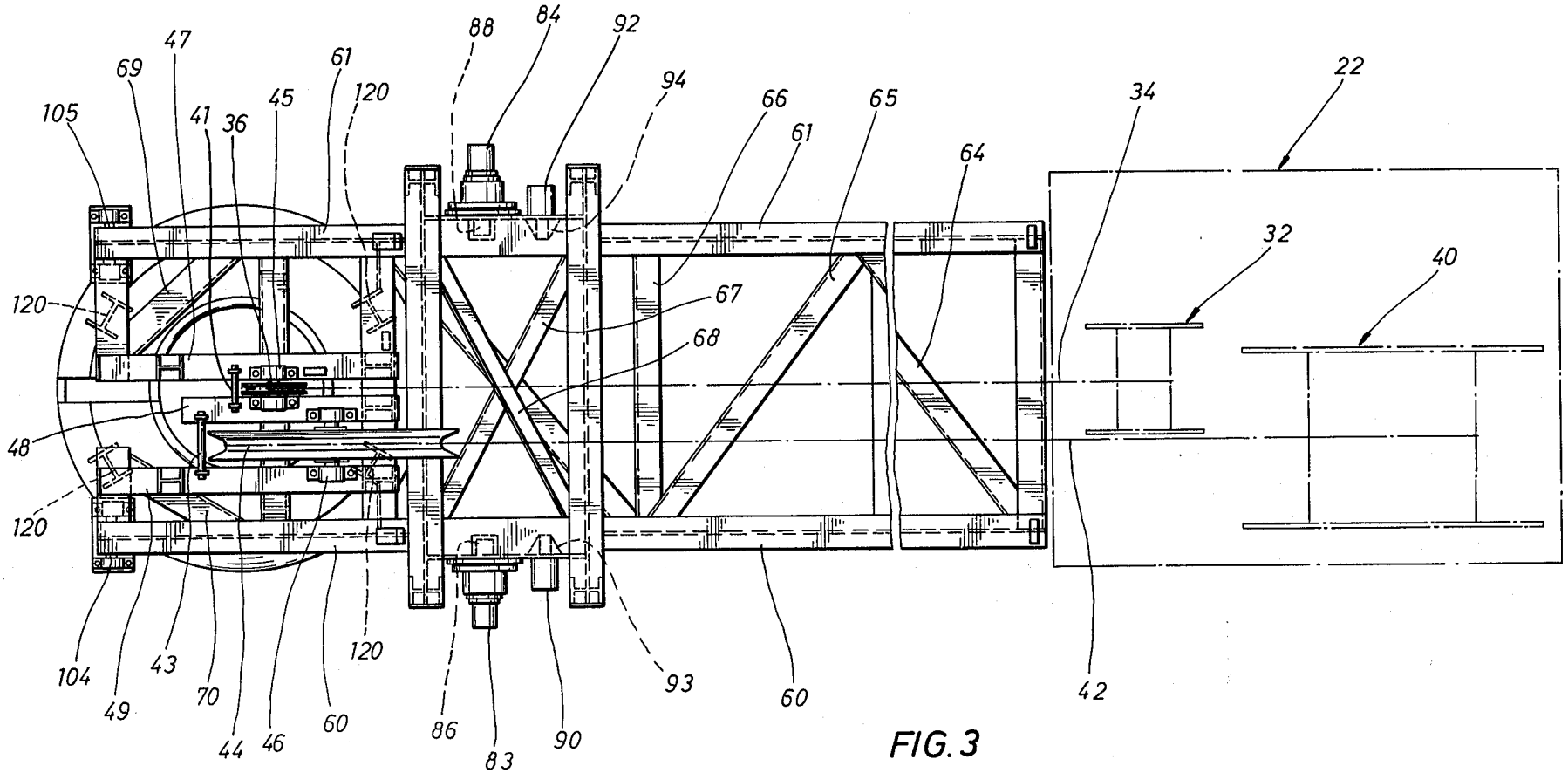
FIG. 3 is a top view of the apparatus illustrated in FIG. 2.

Referring to the drawings and particularly to FIGS. 1–3, a diving bell 10 is shown resting on the deck 11 of a barge or other marine platform. Bell 10 is a conventional diving bell having a generally spherical vessel body 11, a base 12, and an access port 14. Secured to the upper portion of body 11 by vertical supports 17, 18, 19 is a frusto-conical superstructure 16 which, as explained below, engages with a mating member on a stabilized frame to secure the bell in lowering and lifting operations. The illustrated bell has a body diameter of approximately 6 feet and weighs approximately 14,000 pounds, with a preferred buoyancy of minus 1,500 pounds. Although not illustrated, the apparatus and method of the invention may be used for lifting and lowering other submarine vehicles, and, accordingly, the invention is not limited in application to diving bells.

The assembly for handling the diving bell in lowering or lifting operations is generally designated by reference numeral 20 and, as shown in FIG. 1, rests upon the deck house roof 24 of a barge or other marine vessel or platform. Assembly 20 includes a winch unit 22, an extendible and retractable lifting and lowering apparatus 25, and a stationary frame housing 30. In the illustrated embodiment, lifting and lowering apparatus 25 may be selectively positioned in either a retracted position as shown in solid lines in FIG. 1 and in FIGS. 2 and 3 or an extended position over the water as shown in dashed lines in FIG. 1.

Referrng to FIGS. 2 and 3, winch unit 22 includes a bell hoist 32 for driving a wire cable 34 over a sheave 36 and into engagement with the upper portion of the bell 10. An umbilical winch 40 is also mounted within winch unit 22 and serves to supply an umbilical cable 42 to the bell over a sheave 44. Guide rollers, 41, 43 are positioned proximate sheaves 36, 44 to maintain the cables on the sheaves. Sheaves 36 and 44 are rotatably mounted on shafts which are supported in journals 45 and 46 respectively. The journals are attached to horizontal beams 47, 48, 49, which are, in turn, supported by upright support members 53, 54, 55. In the preferred embodiment, hoist 32 and winch 40 are provided with means for maintaining constant tensions in their respective cables so that cables 34 and 42 are automatically paid out or reeled in as the sheaves move between the extended and retracted positions. Although not shown in the drawings, roof 24 includes a recessed slot for accommodating cables 34, 42.

As best shown in FIGS. 2 and 3, upright members 53, 54, 55, are secured by welding or other suitable means to a pair of elongate traveling beams 60, 61. Beams 60, 61 are interconnected by a plurality of trussing members 64–70 (see FIG. 3) to form a trussed structure which serves as the movable frame for lifting and lowering apparatus 25. In the retracted position of apparatus 25, beams 60, 61 run from a point near winch unit 22 to a point near the outboard edge of the deck house roof 24. The beams include integral racks 72 (FIG. 2) and 74 (not shown) along an upper surface thereof. As explained below, each rack engages a mating drive pinion for driving the movable frame between the extended and retracted positions.

Figure 4:
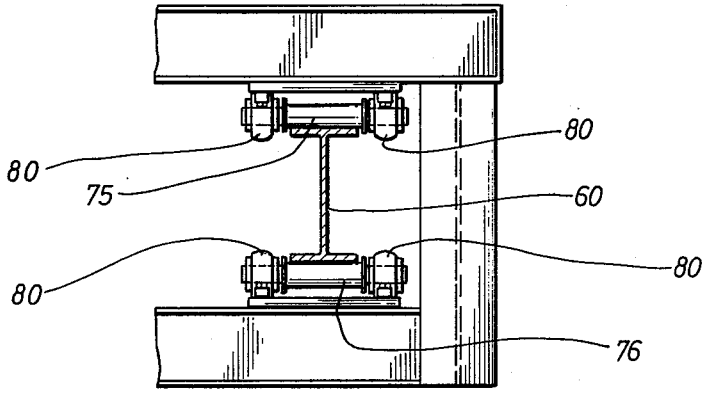
FIG. 4 is a fragmentary section view taken substantially along line 4—4 of FIG. 2.

Each side of stationary frame housing 30 includes four rollers 75, 76, 77, 78 for supporting traveling beams 60, 61. As shown in FIG. 4, these rollers are rotatably mounted on pillar blocks 80 which include suitable bearings.

Figure 5:
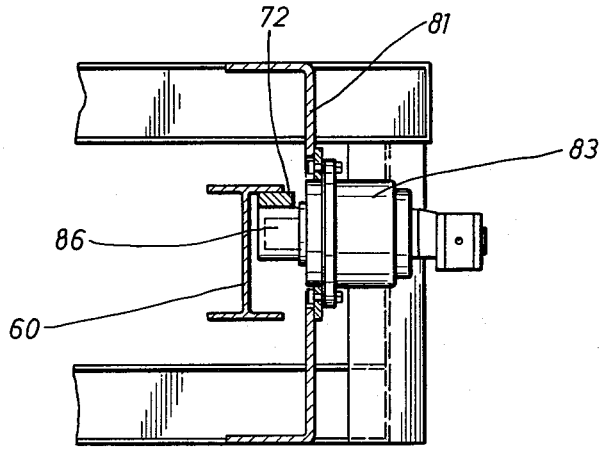
FIG. 5 is a fragmentary section view taken substantially along line 5—5 of FIG. 2.

Referring to FIGS. 3 and 5, housing 30 also includes frames 81 and 82 (not shown) mounting a pair of reversible hydraulic motors 83, 84 which drive pinions 86, 88 respectively. Pinions 86, 88 engage racks 72, 74 for driving the beams between the extended and retracted positions.

Figure 6:
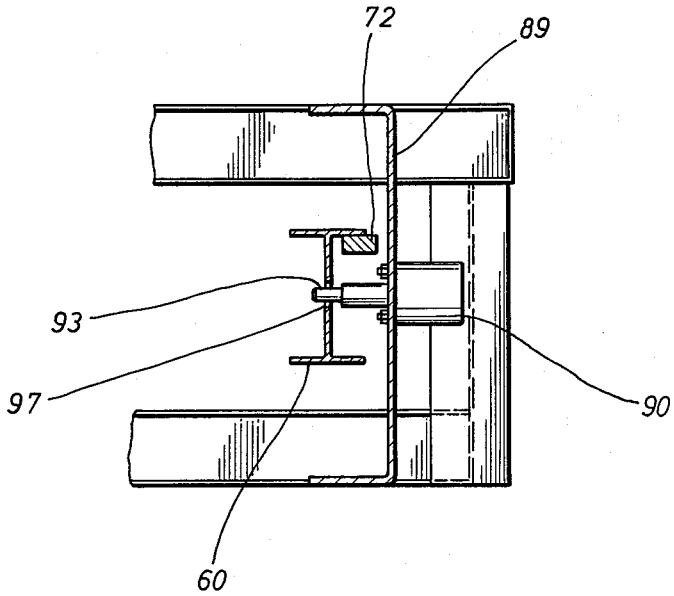
FIG. 6 is a fragmentary section view taken substantially along line 6—6 of FIG. 2.

Referring to FIGS. 3 and 6, the housing 30 has frames 87 and 89 (not shown) for mounting a pair of pneumatic locking cylinders 90 and 92 having respective locking pins 93, 94, extending therefrom. Pins 93, 94 are axially movable by the cylinders and locate within holes in the traveling beams 60, 61 to lock the beams in either the extended or retracted position. For this purpose, each beam 60, 61 includes a hole 96 (FIG. 2) for locking in the extended position and hole 97 (FIG. 6) for locking in the retracted position.

Figure 7:
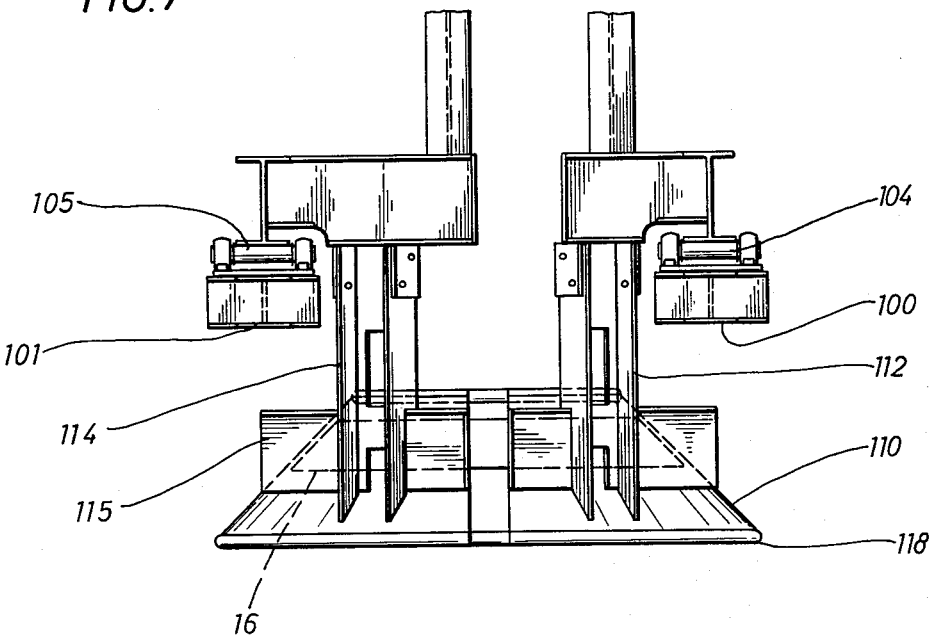
FIG. 7 is a fragmentary end view taken in the direction of line 7—7 of FIG. 2.

Fixedly secured to frame housing 30 and also resting upon deck house roof 24 are a pair of stationary beam support members 100, 101 which primarily serve to support a pair of outboard rollers 104, 105 (see FIGS. 2 and 7). Rollers 104, 105 provide rolling contact and support for beams 60, 61 at the outboard end of the stationary support members 100, 101.

Extending downwardly from beams 60, 61 is a frusto-conical member 110 which is used to engage the mating member formed by superstructure 16 of the diving bell. As best shown in FIGS. 2 and 7, member 110 is secured to the movable frame assembly vertical supports 112 and 114. The supports are reinforced by a stiffener member 115. Member 110 includes a pipe section 118 welded to its lower periphery to strengthen the cone and to prevent deformation of the cone due to abrupt impact. Although member 110 is shown as having a frusto-conical configuration both internally and externally, it should be understood that the outer surface could have another shape provided that the inner wall has a conical configuration corresponding to that of the bell superstructure 16.

Figure 8:
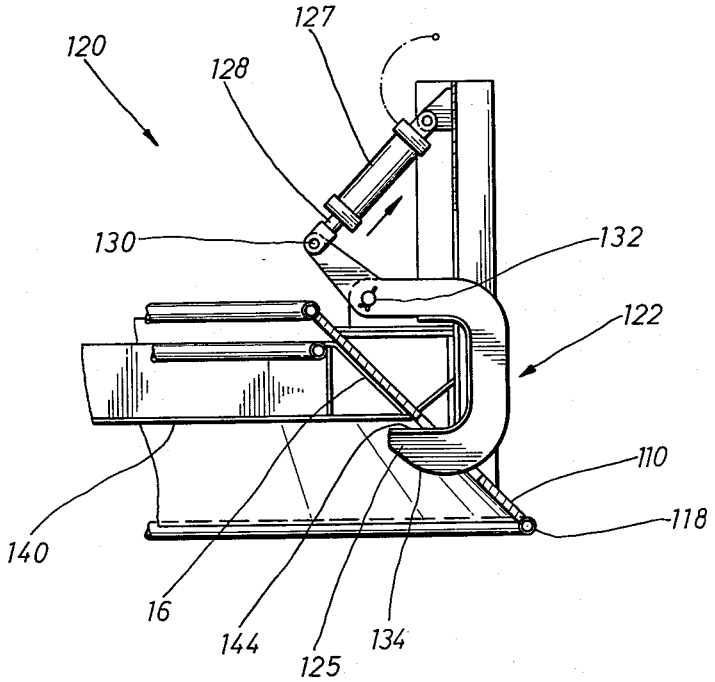
FIG. 8 is an enlarged fragmentary view of one of the locking fingers in a locked position.

The apparatus for automatically locking the superstructure 16 to member 110 will now be described with reference to FIGS. 3 and 8. In the preferred embodiment, locking mechanisms 120 for locking the bell superstructure 16 to member 110 are found at four equally spaced positions on member 110. Each mechanism 120 includes a locking finger 122 which has a tip portion 125 adapted to extend through an opening in member 110. Finger 122 is normally biased inwardly through the opening by a pneumatic cylinder 127 which is normally retracting its piston rod 128 in the direction indicated by the arrow in FIG. 8. This action operates on finger 122 about pivots 130, 132, to urge finger 122 into the opening. It should be noted that a coil spring, leaf spring or other biasing means may be used in the place of cylinder 127. During bell lifting operations when the frustrums are being aligned, the sloped outer portion of frusto-conical bell superstructure 16 engages a camming surface 134 on finger 122 and moves the finger outwardly through the opening against the bias of cylinder 127. As the base 140 of superstructure 16 passes by the camming surface 134, the locking finger snaps back into the opening as shown in FIG. 8 so that base 140 may rest upon support surface 144 of finger 122. Thus, after member 110 and superstructure 16 are fully aligned and mated, the four locking fingers 122 support the superstructure 16 and serve to lock the bell 10 in a stabilized position over the water. As a safety feature the fingers have been designed so that once the lock is complete, the lock will remain secure if cylinders 127 become inoperative.

In a typical operation for lifting a diving bell from the ocean surface, first the locking pins 93, 94 are withdrawn from lock holes 97 so that beams 60, 61 are free to move outwardly over the water. Motors 83, 84 are actuated and the rack-and-pinion drive moves the movable frame outwardly to the extended position shown in dashed lines in FIG. 1. During movement of the frame, bell hoist 32 and umbilical winch 40 pay out their respective cables while maintaining a substantially constant tension. Next, the bell hoist is actuated to lift the bell 10 from the water and toward member 110 at a speed of approximately forty feet per minute. Preferably the bell is lifted from the water at an instant when there is little surface turbulence in order to reduce the initial pendulum effect imparted to the bell by waves. The bell is then raised to a position where the mating cones engage. Without reducing the lifting speed, the cones are allowed to self-center and automatically lock by means of locking fingers 122. With the bell locked in this stabilized position over the water, the locking pins 93, 94 are released and motors 83, 84 are actuated to drive beams 60, 61 back to the retracted position. Locking pins 93, 94 are reinserted into holes 97 to lock the beams in the retracted position. At this time the bell may be lowered to the barge deck where the cylinders 127 operate to release locking fingers 122. The bell may then be aligned for mating to the decompression chamber 150 acording to well known alignment and securement techniques as described, for example, in U.S. Pat. No. 3,323,312. The procedure for transferring the bell from the barge deck to the ocean surface is essentially the reverse of the above-described lifting operation.

In summary, the art is now provided with an apparatus and method for stabilizing the diving bell or other submersible vehicle in a position over the water after it is raised or before it is to be lowered. The pendulum effect is therefore greatly reduced in both lifting and lowering operations. The invention offers a particular advantage in lifting operations since the bell may be rapidly raised to the stabilized position and the rate of lifting does not have to be decreased before the cones lock together in the stabilized position.

What is claimed is:

1. An apparatus for raising a diving bell from the surface of a body of water, securing the bell in a stabilized position over the water and moving the bell to a position over the deck of a marine station, comprising:

reversible drive means mounted on a deck of said station;

a horizontal frame including at least one elongate member having means for engaging said reversible drive means for driving said frame between a first extended position over the water and a second retracted position over the marine station;

a cone member secured to said frame and including a downwardly opening frusto-conical inner surface having a predetermined angular pitch corresponding to the external angular pitch on a mating frusto-conical member secured to the upper portion of the diving bell to be raised;

means secured to said horizontal frame above said cone member for directing a hoist cable into communication with the diving bell to raise the bell frusto-conical member into engagement with said cone member inner surface;

means for locking said bell frusto-conical member to said cone member when they are centered and fully engaged.

2. An apparatus as claimed in claim 1 wherein said means for locking comprises a plurality of locking fingers each having a portion normally biased inwardly through a mating opening in said cone member, camming means on said portion for urging said portion outwardly against the bias during insertion of the bell frusto-conical member into said cone member and a locking surface on said finger for engaging the base of said bell frusto-conical member when fully inserted into said cone member.

3. An apparatus as claimed in claim 1 wherein said reversible drive means comprises a reversible motor driving a pinion and said at least one elongate member includes a rack.

4. An apparatus as claimed in claim 1 wherein said horizontal frame comprises a substantially rectangular trussed frame having a pair of elongate beams defining the longer sides thereof.

5. An apparatus as claimed in claim 4 wherein each beam includes a rack for engaging a pinion driven by said reversible drive means.

6. An apparatus as claimed in claim 1 wherein said means for directing comprises a sheave operatively associated with a winch mounted on the station.

7. A system for handling submarine vehicles comprising:

a frame mounted on a marine station for horizontal movement between a first stabilized extended position over the water and a second retracted position over a deck of the station;

a frusto-conical superstructure mounted on the submarine vehicle;

a cone member secured to said frame and having a downwardly opening frusto-conical inner surface having an angular pitch corresponding to the angular pitch of said superstructure;

means on said frame for directing a hoist cable into communication with the submarine vehicle for lifting the vehicle along a vertical path wherein said superstructure substantially aligns with said cone member inner surface;

locking means for securing said superstructure to said member when they are fully engaged with the inner surface of said cone member lying in a close relation to the outer surface of said superstructure.

8. In a diving bell handling system of the type having means for lowering and lifting the bell from the surface of a body of water to an elevation higher than a selected deck of a marine station, means for positioning the bell over such deck, means for lowering the bell to the deck, and means for positioning the bell and a decompression chamber for interconnection, the IMPROVEMENT comprising a stabilized frame selectively positionable in either a first position extended over the water surface or a second position over the deck, said frame having means for directing a hoist cable therefrom for attachment to the bell, a downwardly opening frustrum secured to said frame and being adapted to mate and self-center with a correspondingly shaped frustrum secured to the top of the bell upon raising of the bell frustrum into engagement therewith, and said downwardly opening frustrum including means associated therewith for locking the mated frustrums together.

9. A system as claimed in claim 8 wherein said means for locking includes a plurality of locking members normally biased inwardly through openings in said downwardly opening frustrum and having locking surfaces for supporting the bell frustrum once it has self-centered and mated within said downwardly opening frustrum.

10. A system as claimed in claim 9 wherein said locking members are pivoted locking fingers biased by fluid cylinders.

11. A system as claimed in claim 10 wherein said cylinders are axially movable for releasing said fingers when the bell has been moved to a position over the deck.

12. A method for elevating a submarine vessel from the surface of a body of water to a stabilized position over the water comprising the steps of:

extending over the water a stabilized support frame including means for directing a vertically movable hoist cable downwardly to the vessel;

affixing to the frame a member having a downwardly opening frusto-conical inner surface;

providing a substantially unobstructed path below the member;

affixing to the upper portion of the vessel a frusto-conical body with an outer surface having a conical configuration for mating with the inner surface of the member;

hoisting the vessel to a position where the vessel frusto-conical body engages with and automatically self-centers for registry with the inner surface of the member;

continuing to hoist the vessel to allow the member and body to self-center and assure a mated position; and with the member and body in the mated position, locking the body to the member.

13. A method as claimed in claim 12 including the step of horizontally moving the member with the body locked thereto to a position over the deck of the vessel.

14. A method as claimed in claim 13 incuding the steps of lowering the bell to the deck and aligning the bell for securement to a decompression chamber.

15. A method as claimed in claim 12 wherein said locking step is performed automatically when the mating frusto-conical members are in complete registry.

16. A method as claimed in claim 15 wherein said locking step is performed by extending locking fingers through openings in the member and into support positions below the body.

* * * * *

UNITED STATES PATENT AND TRADEMARK OFFICE

CERTIFICATE OF CORRECTION

PATENT NO. : 4,111,313

DATED : September 5, 1978

INVENTOR(S) : Max A. W. Reiher and Richard C. Faust

It is certified that error appears in the above-identified patent and that said Letters Patent are hereby corrected as shown below:

Column 3, line 62, should read -- to the movable frame assembly by vertical supports 112 --.

Column 4, line 34, should read -- remain secure even if cylinders 127 become inoperative. --

Column 6, line 65, should read -- and body to self-center and [assure] assume a mated position; --

Signed and Sealed this

*Twenty-seventh* Day of *March 1979*

[SEAL]

*Attest:*

RUTH C. MASON
*Attesting Officer*

DONALD W. BANNER
*Commissioner of Patents and Trademarks*